US005641949A

United States Patent [19]

Yeo

[11] Patent Number: 5,641,949

[45] Date of Patent: Jun. 24, 1997

[54] METHOD AND APPARATUS FOR COUPLING A CYLINDER HEAD—SUCTION MUFFLER ASSEMBLY IN A COMPRESSOR

[75] Inventor: Kerk Kan Yeo, Singapore, Singapore

[73] Assignee: Matsushita Refrigeration Industries (s) Pte. Ltd., Singapore

[21] Appl. No.: 230,307

[22] Filed: Apr. 20, 1994

[30] Foreign Application Priority Data

Apr. 20, 1993 [GB] United Kingdom ..... 9308106

[51] Int. Cl.[6] ..... F02M 35/00

[52] U.S. Cl. ..... 181/229; 181/403; 417/312

[58] Field of Search ..... 181/229, 403; 417/312; 285/305

[56] References Cited

U.S. PATENT DOCUMENTS

| | | | |
|---|---|---|---|
| 4,209,080 | 6/1980 | Douglas | 285/319 X |
| 4,405,163 | 9/1983 | Voges et al. | 285/305 |
| 4,415,060 | 11/1983 | Bar | 181/403 X |
| 4,784,581 | 11/1988 | Fritchman | 417/312 |
| 5,207,564 | 5/1993 | Fritchman | 417/312 |
| 5,304,044 | 4/1994 | Wada et al. | 417/312 |

*Primary Examiner*—Khanh Dang

*Attorney, Agent, or Firm*—Lawrence Y. D. Ho

[57] ABSTRACT

The present invention describes an improved cylinder head-suction muffler assembly which minimizes the fabrication and installation process of the same. The improved cylinder head-suction muffler assembly comprises a suction muffler, a capillary tube and a cylinder head. The cylinder head has only one conical bore for receiving a similarly shaped muffler tube of the suction muffler. A capillary tube clip is integrated with the muffler tube for receiving and securing the capillary tube to the cylinder head-suction muffler assembly. The procedure of installing the new cylinder head-suction muffler is simplified to two steps: (1) inserting the suction muffler into the cylinder head and (2) inserting the capillary tube into the suction muffler by securing it to the capillary tube clip. As such, material cost and processing steps are minimized.

5 Claims, 4 Drawing Sheets

(PRIOR ART 1)

(PRIOR ART 2)

METHOD AND APPARATUS FOR COUPLING A CYLINDER HEAD—SUCTION MUFFLER ASSEMBLY IN A COMPRESSOR

BACKGROUND OF THE INVENTION

1. Field of the Invention

This invention relates to improvements in the fabrication and coupling of cylinder head-suction muffler assembly in rotating machines, and in particular, of sealed reciprocating and rotary compressors for refrigeration and air conditioning.

2. Description of the Prior Art

The function of sealed compressors for cooling fluids is well known in the art. Typically, an electric motor drive is built into a sealed housing or shell, and has a stator or electric armature affixed therein and a rotor assembly assembled into the cylindrical passage of the stator. This rotor assembly includes a rotor and a crankshaft which is inserted into the cylindrical passage of the rotor by interference fit. The reciprocating motion of the rotor and the piston in the compression chamber compresses low pressure gas into high pressure gas. The gas comprises typically freon or substitutes thereof. The low pressure gas comes from the closed loop system and enters a suction chamber through a cylinder head-suction muffler assembly. At the suction chamber, the low pressure gas is drawn into a compression chamber during the suction stroke of the reciprocating machine. A negative vacuum pressure is created. At the same time, lubricating fluid is also drawn into the suction chamber from a sump at the base of the crankshaft through a capillary tube for mixing with inert gas and lubricating the compression chamber. The compressed gas in the compression chamber is directed to the condenser of the system through a discharge valve, a discharge muffler, discharge line and tube discharge.

The prior art cylinder head-suction muffler assembly comprises a suction muffler, a capillary tube, a support plate, screws, and a cylinder head. The fabrication of the cylinder head requires at least one bore and two tightening holes to be made on the cylinder head. Similarly, the installation of the cylinder head-suction muffler requires at least five steps: (1) insert the suction tube of the suction muffler into the suction bore of the cylinder head, (2) fit the capillary tube onto the suction muffler, (3) place the support plate over the capillary tube and the two tightening holes, (4) insert screws into the holes, and (5) tighten the screws. It follows from the above that the prior art cylinder head-suction muffler assembly not only requires additional machining and handling, but the process of assembling it is time and labour intensive.

SUMMARY OF THE INVENTION

The present invention describes an improved cylinder head-suction muffler assembly which minimizes the fabrication and installation process of the same. The improved cylinder head-suction muffler assembly comprises a suction muffler, a capillary tube and a cylinder head. The cylinder head has only one conical bore for receiving a similarly shaped muffler tube of the suction muffler. A capillary tube clip is integrated with the cylinder head for receiving and securing the capillary tube to the cylinder head-suction muffler assembly. The procedure of installing the new cylinder head-suction muffler is simplified to two steps: (1) inserting the suction muffler into the cylinder head and (2) inserting the capillary tube into the suction muffler by securing it to the capillary tube clip. As such, material cost and processing steps are minimized.

DESCRIPTION OF THE PREFERRED EMBODIMENT

Figure 1:
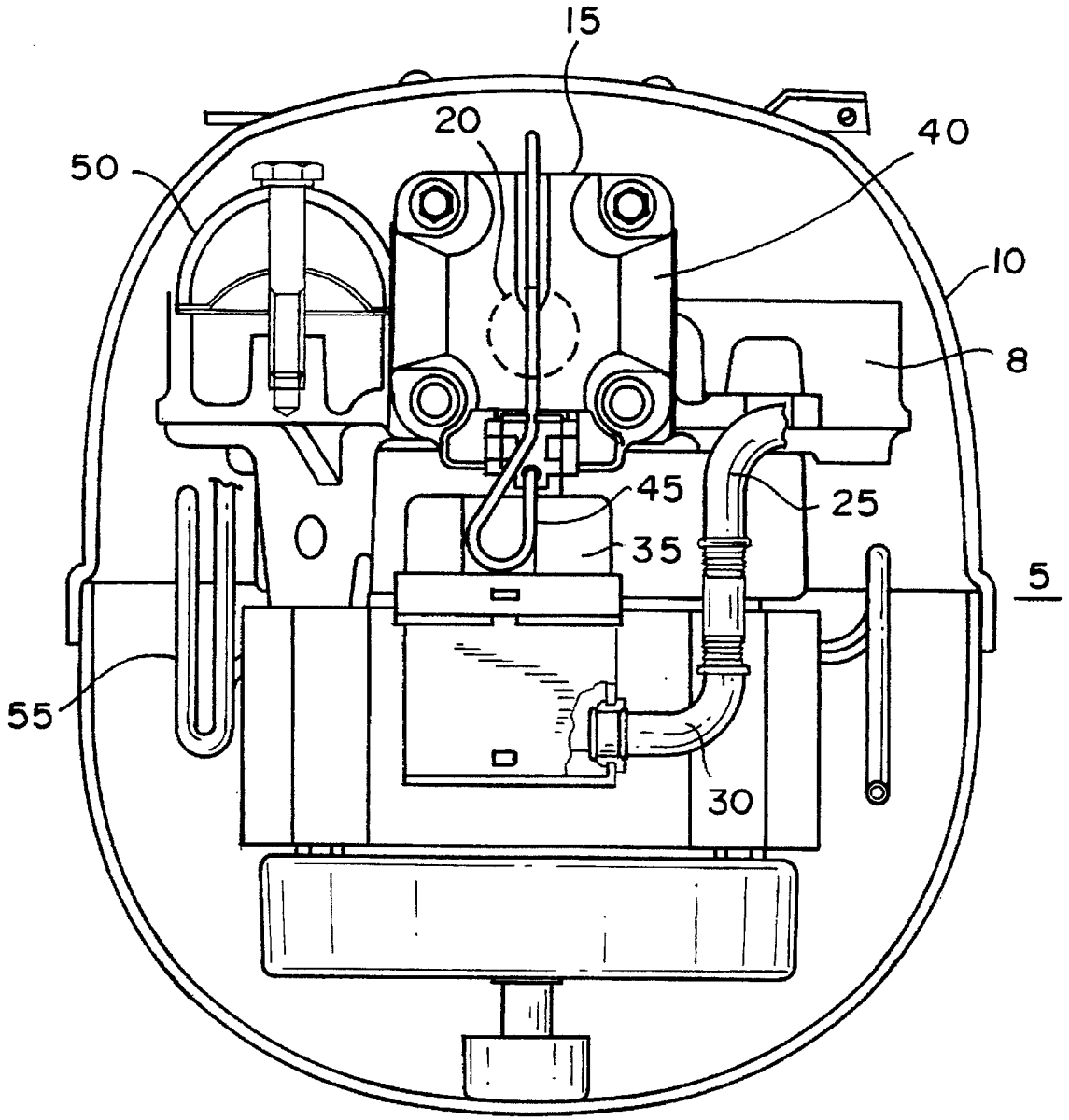
FIG. 1 is a cross section elevational view of sealed compressor showing the cylinder head-suction muffler assembly.

FIG. 1 is a cross section elevational view of sealed compressor 5 showing an electric motor drive 8 being built into a shell 10 and having a cylinder head-suction muffler assembly 15 being coupled to a compression chamber 20 (shown in dotted line). Low pressure gas from the air conditioning system (not shown) enters the suction muffler 35 of the cylinder head-suction muffler assembly 15 via tube section 25 and insert tube 30. The cylinder head 40 is coupled to the compression chamber 20 for channelling the low pressure gas into the compression chamber 20 during the suction stroke of the reciprocating compressor 5. A negative vacuum pressure is created in the compression chamber. Lubricating fluids from a sump in the compressor 5 is also drawn into a capillary tube 45 into the compression chamber 20 so that the lubricating fluids mixes with the inert gas to lubricate the compression chamber. The high pressure gas from the compression chamber exits the compressor 5 via a discharge chamber 50 and a discharge line 55. From there the high pressure gas flows to the condenser of the system (not shown).

Figure 2:
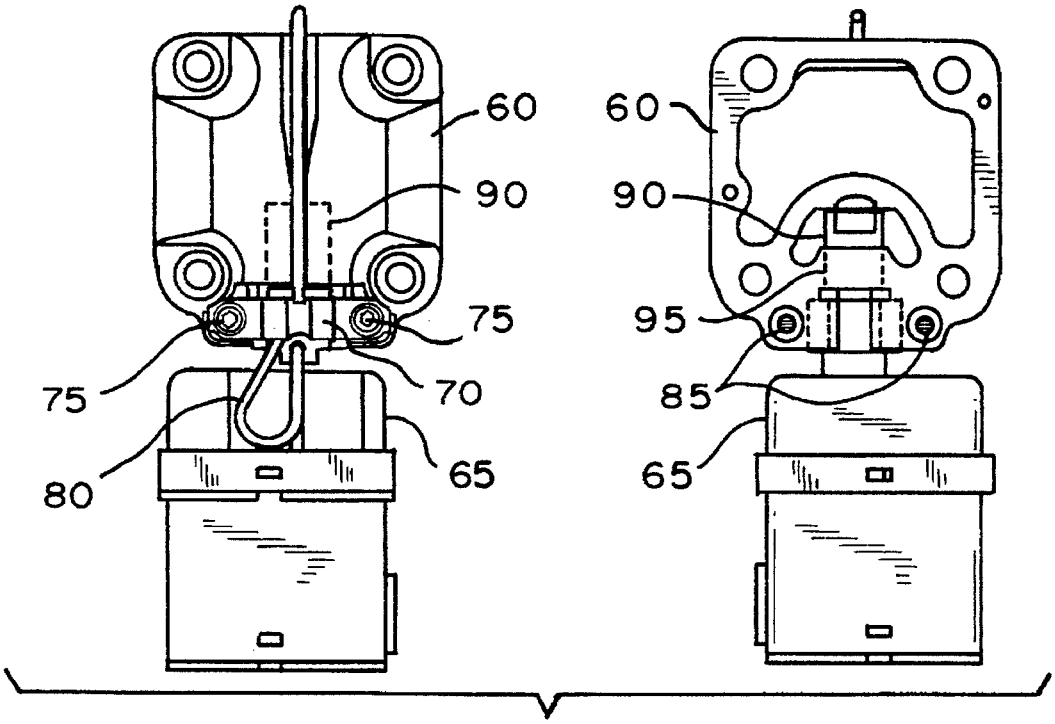
FIG. 2 is a top and bottom view of a prior art cylinder head-suction muffler assembly.

FIG. 2 is a top and bottom view of a prior art cylinder head-suction muffler assembly. The assembly comprises a cylinder head 60, a suction muffler 65, a support plate 70, screws 75 and a capillary tube 80. The bottom view of the prior art cylinder head shows two tightening holes 85 for receiving the screws 75 and also a suction bore 95 for accommodating a muffler tube 90 of the suction muffler 65. During the fabrication stage of the various components of the cylinder head-suction muffler assembly, the cylinder head requires the additional machining process of creating the tightening holes 85. At the installation stage of the cylinder head-suction muffler assembly, the following five steps are required: (1) insert the suction tube 95 of the suction muffler 65 into the suction bore 95 of the cylinder head 60, (2) fit the capilliary tube 80 onto the suction muffler 65, (3) place the support plate 70 over the capillary tube 80 and the two tightening holes 85, (4) insert screws 75 into the holes 85, and (5) tighten the screws 75. It follows from the above that the prior art cylinder head—muffler assembly not only requires additional maching and handling, but the process of assembling it is time and labour intensive.

Figure 3:
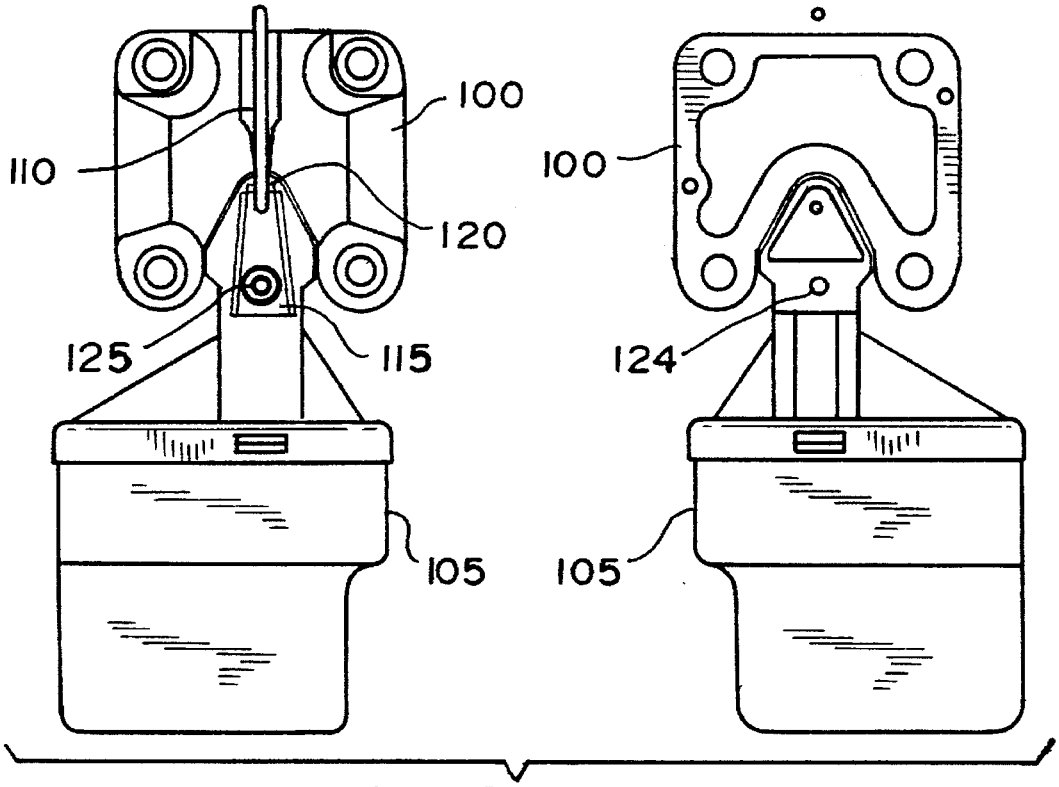
FIG. 3 is a top and bottom view of another prior art cylinder head-suction muffler assembly.

FIG. 3 is a top and bottom view of another prior art cylinder head—suction muffler assembly. Here, the cylinder head 100, suction muffler 105 and capillary tube 110 are identical to those in FIG. 2. The improved support plate 115 has only one tightening hole 124 and a single screw 125. Furthermore, the elongated support plate 115 has on one edge a L-shape clip 120 for securing the capillary tube 110 to the cylinder head-suction muffler assembly. The machining of the assembly is extensive as the suction muffler requires one tightening hole 124. Moreover, the number of steps needed for installing the assembly remains the same as the assembly as described in FIG. 2: (1) insert the suction tube of the suction muffler 105 into the suction bore of the cylinder head 100, (2) place the support plate 115 over the suction muffler 105, (3) insert screws 125 into the holes 124, (4) fit the capillary tube 110 over the support plate 115 and snap the tube into the clip 120, and (5) tighten the screws 125. The prior art cylinder head-suction muffler assembly in FIG. 3 requires less machining of the cylinder head but the installation steps are just as complicated as that in FIG. 2.

Figure 4:
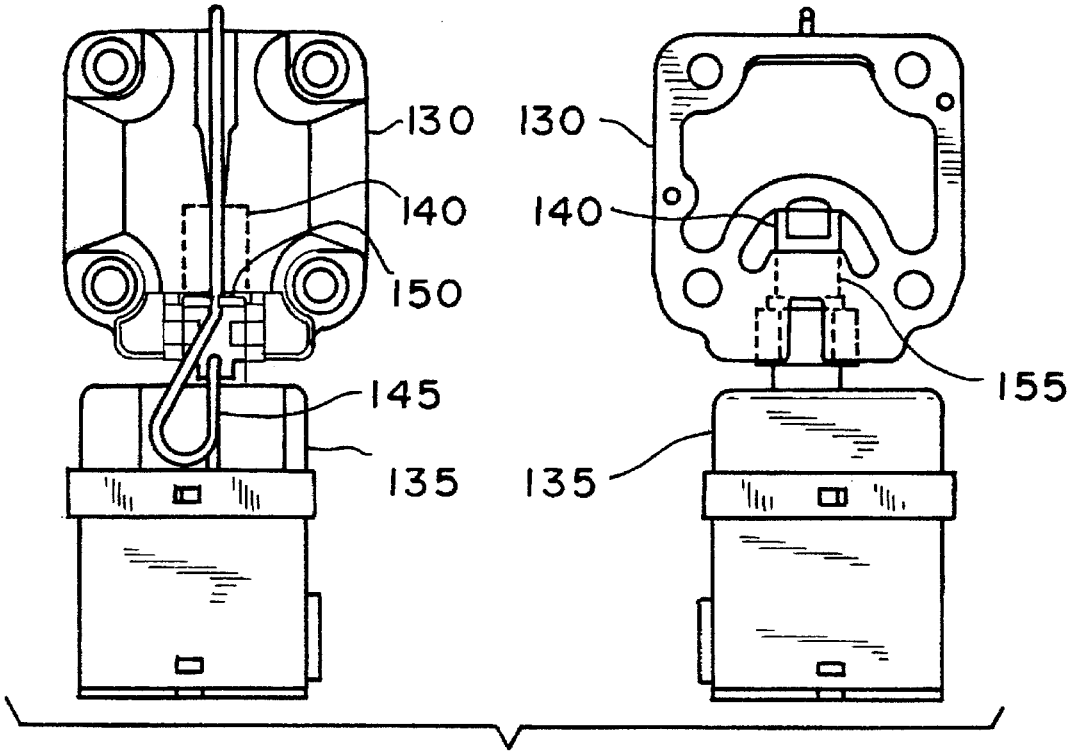
FIG. 4 is a top and bottom view of the present invention.

FIG. 4 is a top and bottom view of the present invention. The new cylinder head-suction muffler assembly comprises a cylinder head 130, a suction muffler 135, a capillary tube 145 and a capillary tube clip 150 having a cavity disposed therein to receive and hold the capillary tube 145. The machining of the cylinder head 130 is kept to a minimum by requiring one conical bore 155 for receiving a tapered end muffler tube 140. Unlike prior art assemblies in FIGS. 2 and 3, only two installation steps are needed for the present invention; (1) insert the suction muffler tube 140 of suction muffler 135 into the conical bore 155 on cylinder head 130 and (2) fit the capillary tube 145 over the suction muffler 135 by snapping the capillary tube 145 into the clip 150.

Figure 5:
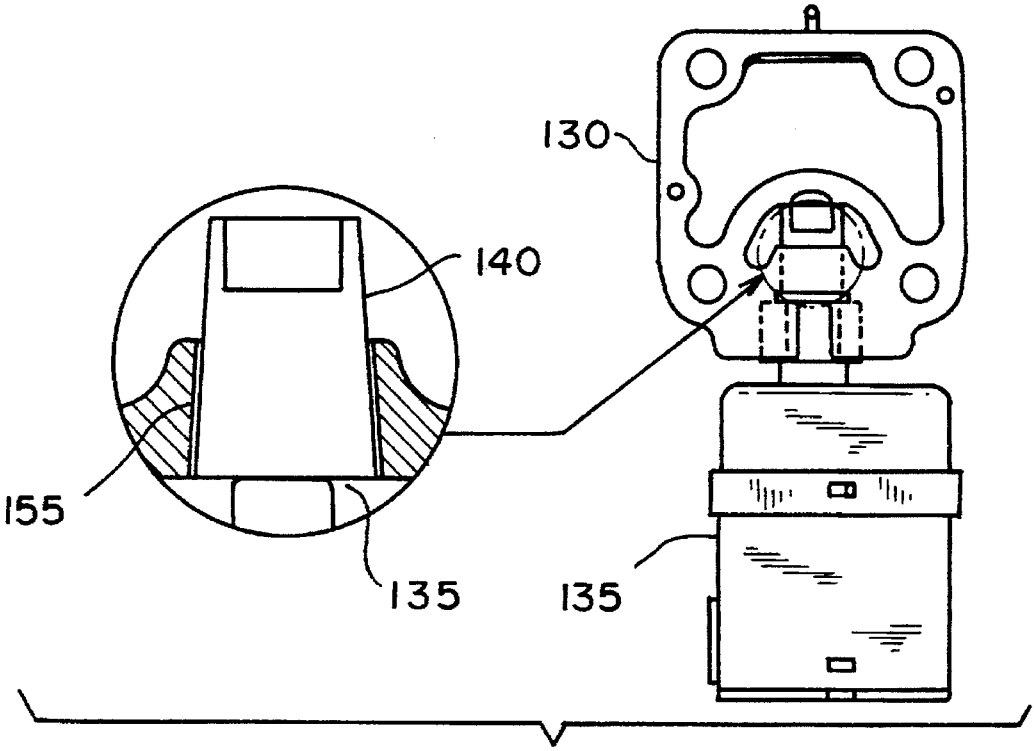
FIG. 5 illustrates an exploded cross section view of the new bore in the cylinder head of the present invention.

FIG. 5 illustrates an exploded cross section view of the new bore 155 in the cylinder head 130 of the present invention which enables the suction muffler 135 to be coupled to the cylinder head 130 by a "press fit" process. The muffler tube 140 is tapered such that the suction muffler 135 can be inserted into the conical bore 155 of the cylinder head. The friction force coupled with the retaining force of the capillary tube—clip connection holds the cylinder head-suction muffler in place without requiring additional machining and installation steps.

Figure 6:
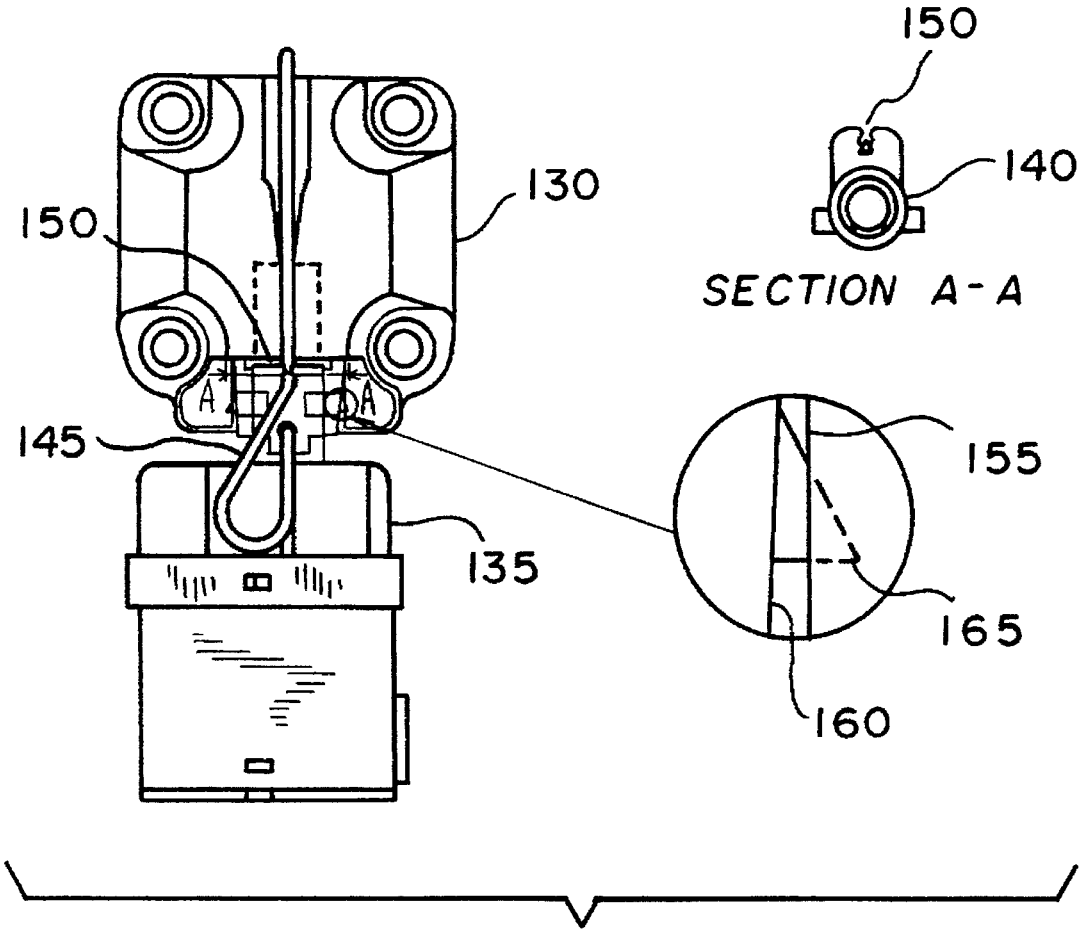
FIG. 6 shows a front elevational view of the capillary tube clip according to section A—A as well as a second embodiment of the muffler tube of the present invention.

FIG. 6 shows a front elevational view of the capillary tube clip 150 in accordance to section A—A as well as a second embodiment of the muffler tube of the present invention. It should be understood by one skilled in the art that the capillary tube clip is integrated with the body of the muffler tube 160 of the suction muffler 135. An alternative conical bore 155 and the muffler tube 160 is also illustrated. There is a non-reversible catch 165 on the tapered end muffler tube 160 with a corresponding mating latch for receiving the catch 165. This second embodiment ensures that the suction muffler 135 is securely fastened to the cylinder head 130. The matching latch could be conveniently designed into the casting mold for the cylinder without requiring any additional matching. It should be understood that the same number of steps of installation is maintained for the assembly in FIG. 6 as that in FIG. 4.

While the present invention has been described particularly with reference to FIGS. 1 to 6 with emphasis on a method and apparatus for coupling a cylinder head-suction muffler assembly in a compressor, it should be understood that the figures are for illustration only and should not be taken a limitation on the invention. In addition, it is clear that the apparatus of the present invention has utility in many applications where the coupling of gas under parts is required. It is contemplated that many changes and modifications may be made by one of ordinary skill in the art without departing from the spirit and the scope of the invention as described.

I claim:

1. An improved cylinder head-suction muffler assembly in a compressor housing a compression chamber for compressing fluids, said assembly comprising a suction muffler;

a capillary tube;

a muffler tube projecting out from said suction muffler, said tube having a hole which receives and retains an end of the capillary tube;

a capillary tube clip integrated with said muffler tube, said clip having a cavity which receives and tightly holds the capillary tube; and a cylinder head coupled to the compression chamber of the compressor, said cylinder head having a bore adapted to fittingly receive said muffler tube, whereby a frictional force between said muffler tube and said cylinder head, and retaining force of said capillary tube prevent inadvertent disengagement of said muffler tube from said bore without requiring an external fastener.

2. The assembly according to claim 1 wherein said bore is of a conical shape.

3. The assembly according to claim 2 wherein said muffler tube of said suction muffler is tapered.

4. The assembly according to claim 3 wherein said muffler tube has a non-reversible catch for securing said suction muffler to said cylinder head.

5. The assembly according to claim 4 wherein said conical bore of said cylinder head has a mating latch for receiving said non-reversible catch.

* * * * *